United States Patent [19]

Mailloux

[11] 4,063,810

[45] Dec. 20, 1977

[54] COLOR TRANSPARENCY REPRODUCING MACHINE

[75] Inventor: Louis D. Mailloux, Fairport, N.Y.

[73] Assignee: Xerox Corporation, Stamford, Conn.

[21] Appl. No.: 706,102

[22] Filed: July 16, 1976

Related U.S. Application Data

[62] Division of Ser. No. 540,617, Jan. 13, 1975, Pat. No. 4,027,962.

[51] Int. Cl.[2] ..... G03G 15/01

[52] U.S. Cl. ..... 355/4; 250/326; 355/3 CH

[58] Field of Search ..... 355/3 R, 3 CH, 4, 7, 355/8, 32, 44, 75, 88; 250/324, 325, 326

[56] References Cited

U.S. PATENT DOCUMENTS

| | | | |
|---|---|---|---|
| 3,357,830 | 12/1967 | Bixby | 355/4 X |
| 3,439,983 | 4/1969 | Blow | 355/8 |
| 3,542,468 | 11/1970 | Blow | 355/18 |
| 3,620,617 | 11/1971 | Kelly et al. | 250/325 X |
| 3,833,293 | 9/1974 | Serio et al. | 355/4 X |
| 3,942,006 | 3/1976 | Hayne | 250/326 |

*Primary Examiner*—Fred L. Braun

*Attorney, Agent, or Firm*—J. J. Ralabate; C. A. Green; H. Fleischer

[57] ABSTRACT

An electrophotographic printing machine in which color transparencies are reproduced. A projected image of the color transparency is scanned forming a light image thereof. The light image is modulated and filtered creating a single color half-tone light image. A charged photoconductive member is irradiated by the single color half-tone light image recording a single color electrostatic latent image thereon.

2 Claims, 6 Drawing Figures

COLOR TRANSPARENCY REPRODUCING MACHINE

This is a division, of application Ser. No. 540,617, filed Jan. 13, 1975, now U.S. Pat. No. 4,027,962.

BACKGROUND OF THE INVENTION

This invention relates generally to an electrophotographic printing machine, and more particularly concerns a color electrophotographic printing machine adapted to reproduce color transparencies.

The process of electrophotographic printing comprises exposing a charged photoconductive member to a light image of an original document. The irradiated areas of the photoconductive surface are discharged to record thereon an electrostatic latent image corresponding to the original document. A development system, thereupon, moves a developer mix of carrier granules and toner particles into contact with the photoconductive surface. The toner particles are attracted electrostatically from the carrier granules to the latent image forming a toner powder image thereon. Thereafter, the toner powder image is transferred to a sheet of support material. After the toner powder image has been transferred to the sheet of support material, the sheet of support material advances to a fuser which permanently affixes the toner powder image thereto.

The foregoing briefly describes the basic concept of electrophotographic printing. A wide variety of machines and devices have been developed for mechanization of this concept. The teachings of the prior art machines have, in the most part, been utilized to improve copies reproduced therein on a commercial basis. These improvements have been generally designed to solve a specific problem. Thus, for example, machines are presently in wide commercial use for reproducing microfilm. Machines of this type are described in U.S. Pat. No. 3,424,525 issued to Towers, et al. in 1969, U.S. Pat. No. 3,542,468 issued to Blow, Jr., in 1970 and U.S. Pat. No. 3,547,533 issued to Stokes, et al. in 1970.

In machines of the foregoing type, an enlarged copy of a microfilm input is reproduced. However, in all of the foregoing machines, it is extremely difficult to form reproductions of transparencies having photographic quality. Furthermore, no machines have been developed to produce photographic quality color copies from color transparencies, such as 35 mm slides.

With the advent of color electrophotographic printing, it has become highly desirable to reproduce color transparencies as pictorial quality color opaque copies. Essentially, multicolor printing repeats the process of black and white copying a plurality of cycles, each cycle being for a different color. By way of example, the light image is filtered to record an electrostatic latent image on a photoconductive surface corresponding to a single color in the original document. The single color electrostatic latent image is then developed with toner particles complementary in color to the filtered light image. The toner powder image is then transferred to a sheet of support material. The foregoing process is repeated for successively differently colored light images. In this manner, a plurality of toner powder images are transferred to the sheet of support material, in superimposed registration with one another. Each of the toner powder images are complementary in color to the color of the filter utilized to produce the light image projected onto the photoconductive member. After a plurality of toner powder images have been transferred to the sheet of support material in superimposed registration with one another, the multi-layered toner powder image is permanently affixed thereto. The foregoing process is more fully described in U.S. Pat. No. 3,799,668 issued to McVeigh in 1973.

In color electrophotographic printing machines, the original document disposed upon a transparent platen is scanned to form a flowing light image thereof. Frequently, it is desirable to place a color transparency rather than a colored opaque copy on the platen as an original document. However, it has been found that the illumination system of the printing machine does not possess sufficient intensity. Light rays cannot pass through the image and reflect from the platen cover back through the transparency onto the photoconductive surface. Thus, it has not been feasible to reproduce color transparencies on a color electrophotographic printing machine.

Accordingly, it is a primary object of the present invention to improve color electrophotographic printing machines so as to enable color transparencies to be reproduced thereon.

SUMMARY OF THE INVENTION

Briefly stated, and in accordance with the present invention, there is provided an electrophotographic printing machine for reproducing color transparencies.

Pursuant to the features of the present invention, means are provided for illuminating and modulating a color transparency image formed on a receiving member. Exposing means form a half-tone light image of the illuminated and modulated color transparency image produced on the receiving member. Filtering means filter the half-tone light image forming a single color light image which irradiates a charged photoconductive member. In this manner, a single color electrostatic latent image is recorded on the photoconductive member.

BRIEF DESCRIPTION OF THE DRAWINGS

Other objects and advantages of the present invention will become apparent upon reading the following detailed description and upon reference to the drawings, in which.

Figure 1:
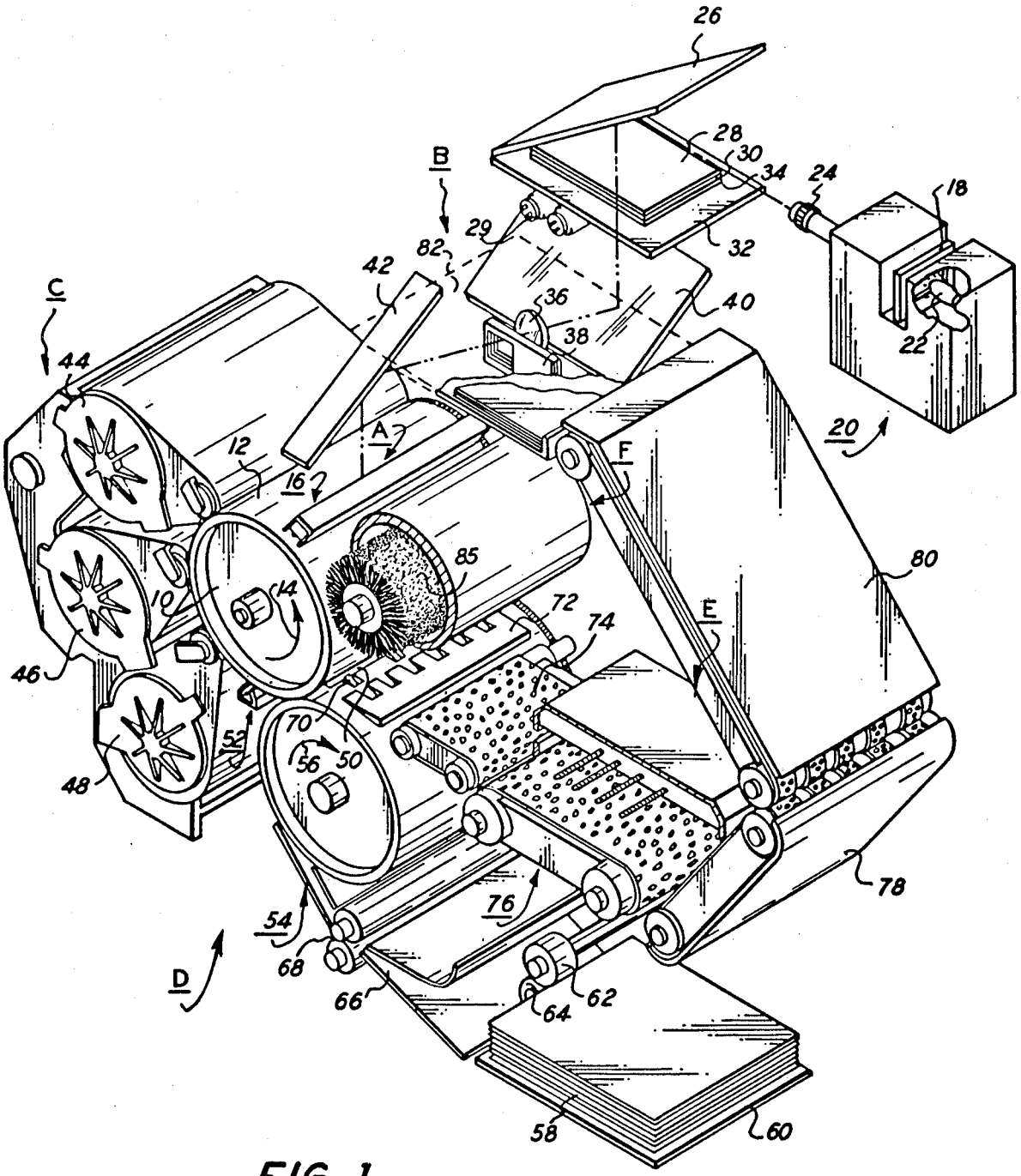
FIG. 1 is a schematic perspective view of an electrophotographic printing machine incorporating the features of the present invention therein.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

For a general understanding of the disclosed color electrophotographic printing machine of the present invention, continued reference is had to the drawings. In the drawings, like reference numerals have been used throughout to designate like elements. Initially, the overall process for producing color copies from color transparencies will be described with reference to FIG. 1. Thereafter, the detailed structural configuration of the various sub-assemblies utilized in the FIG. 1 printing machine will be discussed in greater detail. Although the color electrophotographic printing machine of the present invention is particularly well adapted for producing color copies from color transparencies, it should become evident from the following discussion that it is equally well suited for producing color copies from opaque originals or black and white copies from black and white transparencies and is not necessarily limited to the particular embodiment described herein.

As depicted in FIG. 1, the electrophotographic printing machine employs a photoconductive member having a drum 10 mounted rotatably within the machine frame (not shown). Photoconductive surface 12 is mounted on the exterior circumferential surface of drum 10 being entrained thereabout. A selenium alloy is a suitable photoconductive material. One type of suitable selenium alloy is disclosed in U.S. Pat. No. 3,655,377 issued to Sechak in 1972.

A series of processing stations are positioned about the periphery of drum 10. In this way, as drum 10 rotates in the direction of arrow 14, it passes sequentially through each of the processing stations. Drum 10 is driven at a predetermined speed relative to the other machine operating mechanisms from a common drive motor (not shown). A timing disc is mounted in the region of one end of the shaft of drum 10. The timing disc cooperates with the machine logic to synchronize various operations at the respective processing stations with the rotation of drum 10. In this way, the proper sequence of events is controlled at the respective processing station.

Initially, drum 10 rotates photoconductive surface 12 through charging station A. At charging station A, a corona generating device, indicated generally by the reference numeral 16, extends in a longitudinal direction transversely across photoconductive surface 12. Corona generating device 16 will be described hereinafter in greater detail, with reference to FIG. 2. However, briefly, corona generating device 16 sprays ions onto photoconductive surface 12 producing a relatively high, substantially uniform charge thereon.

After photoconductive surface 12 is charged to a substantially uniform potential, drum 10 is rotated to exposure station B. At exposure station B, a color filtered light image of color transparency 18, or a 35 mm slide, is projected onto charged photoconductive surface 12. Color transparency 18 is disposed in slide projector 20. Slide projector 20 includes a light source 22 adapted to illuminate transparency 18. In addition, slide projector 20 comprises a lens having an adjustable focus to produce an enlarged or magnified image of color transparency 18. A suitable type of slide projector is sold under the tradename Carousel, model number 750-H, manufactured by the Eastman Kodak Corporation of Rochester, New York. The enlarged image of color transparency 18 is directed onto mirror 26. Mirror 26 reflects the enlarged image in a downward direction onto Fresnel lens 28. A dot screen 30 is disposed beneath Fresnel lens 28. Interposed between dot screen 30 and transparent platen 32 is an optional opaque sheet 34 having an aperture therein, i.e. a picture frame or textured information frame, which may be considered as a composition frame. Composition frame 34 defines an opaque border extending outwardly from the color transparency image formed on platen 32. Frame 34 may have indicia inscribed thereon. Thus, dot screen 30 modulates the color transparency image forming a half-tone light image which is combined with the image of composition frame 34 forming a combined image. In this manner, a combined image is formed on transparent platen 32. This enables the scanning system to form a flowing half-tone light image thereof. The scanning system includes a moving lens system generally designated by the reference numeral 36 and a color filter mechanism shown generally at 38. Lamps 29 are adapted to move in a timed relationship with lens 36 and filter mechanism 38 to scan and illuminate successive incremental areas of composition frame 34 which may be optionally placed on platen 32. In this manner, a combined flowing light image of the enlarged color transparency image, which passes through dot screen 30 and composition frame 34 is formed. A size for size rather than enlarged copy of the transparency may be optionally formed in lieu of, or in addition to, the projected image. In this mode, projector 20 merely serves as an additional illumination source. Transparency 18 is placed on platen 32 beneath dot screen 30. Composition frame 34 may still be positioned over a portion of platen 32 so as to combine the composition frame image with the size for size transparency image. The combined light image is reflected from mirror 40 through lens 36 and filter 38 forming a single color light image. The single color light image is reflected by mirror 42 onto charged photoconductive surface 12 recording a single color electrostatic latent image thereon. Filter mechanism 38 interposes selected color filters into the optical path of lens 36 during the exposure process. The appropriate filter operates on the light rays transmitted through lens 36 to record an electrostatic latent image on photoconductive surface 12 corresponding to a preselected spectral region of the electromagnetic wave spectrum, hereinafter referred to as a single color electrostatic latent image. The exposure system will be discussed in greater detail with reference to FIG. 3.

After the electrostatic latent image is recorded on photoconductive surface 12, drum 10 rotates to development station C. At development station C, three individual developer units, generally indicated by the reference numerals 44, 46 and 48, respectively, are arranged to render visible the electrostatic latent image recorded on photoconductive surface 12. Preferably, each of the developer units are of a type generally referred to in th art as "magnetic brush developer units". A typical magnetic brush system utilizes a magnetizable developer mix which includes carrier granules and toner particles. Generally, the toner particles are heat settable. In operation, the developer mix is continually brought through a directional flux field to form a brush thereof. The electrostatic latent image recorded on photoconductive surface 12 is brought into contact with the brush of developer mix. Toner particles are attracted from the developer mix to the latent image. Each of the developer units contain approximately colored toner particles. For example, a green filtered light image is developed by depositing magenta toner particles thereon. Similarly, a red filtered light image is developed with cyan toner particles and a blue filtered light image with yellow toner particles. The development system employed in the FIG. 1 printing machine will be discussed, in greater detail, with reference to FIG. 4.

After the single color electrostatic latent image is developed with toner particles complementary in color thereto, drum 10 is rotated to transfer station D. At transfer station 10, the toner powder image adhering electrostatically to photoconductive surface 12 is transferred to a sheet of support material 50. Support material 50 may be plain paper or a sheet of thermoplastic material, amongst others. Transfer station D includes corona generating means, indicated generally at 52, and a transfer member, designated generally by the reference numeral 54. Corona generator 52 is excited with an alternating current and is arranged to precondition the toner powder image adhering electrostatically to photoconductive surface 12. In this manner, the preconditioned toner powder image will more readily be transferred from the electrostatic latent image recorded on photoconductive surface 12 to support material 50 by transfer member 54. Transfer member 54 is a roll adapted to recirculate support material 50 and is electrically biased to a potential of sufficient magnitude and polarity to attract electrostatically the preconditioned toner particles from the latent image recorded on photoconductive surface 12 to support material 50. Transfer roll 54 rotates in synchronism with drum 10 to maintain the electrostatic latent image recorded on photoconductive surface 12 in registration with support material 50 secured releasably thereto. Inasmuch as support material 50 is secured releasably on transfer member 54 for movement in a recirculating path therewith, successive toner powder images may be transferred thereto in superimposed registration with one another. In this case, transfer roll 54 rotates, in the direction of arrow 56, at substantially the same angular velocity as drum 10. Corona generator 52 and transfer roll 54 will be described hereinafter in greater detail with reference to FIG. 5.

Prior to proceeding with the remaining stations disposed about the periphery of drum 10, the sheet feeding process will be briefly described. Support material 50 is advanced from a stack 58 mounted on a tray 60. Feed roll 62, in operative communication with retard roll 64, advances and separates the uppermost sheet from stack 58. The advancing sheet moves into chute 66 which directs it into the nip between register rolls 68. Thereafter, gripper fingers, indicated generally at 70, mounted on transfer roll 54 secure support material 50 releasably thereto for recirculating movement therewith. After the requisite number of powder images have been transferred to support material 50, gripper fingers 70 release support material 50 and space it from transfer roll 54. Stripper bar 72 is interposed therebetween to separate support material 50 from transfer roll 54. Thereafter, endless belt conveyor 74 advances support material 50 to fixing station E.

At fixing station E, a fuser, indicated generally by the reference numeral 76, generates sufficient heat to permanently affix the transferred powder images to support material 50. Fuser 76 will be discussed hereinafter in greater detail with reference to FIG. 6. After the fixing process, support material 50 is advanced by endless belt conveyors 78 and 80 to catch tray 82 permitting the machine operator to remove the finished copy from the printing machine.

Although a preponderance of the toner particles are transferred to support material 50, invariably some residual toner particles remain on photoconductive surface 12 after the transfer of the powder image therefrom. Residual toner particles are removed from photoconductive surface 12 as it moves through cleaning station F. At cleaning station F, the residual toner particles are initially brought under the influence of a cleaning corona generating device (not shown) adapted to neutralize the electrostatic charge remaining on the residual toner particles and photoconductive surface 12. The neutralized toner particles are then cleaned from photoconductive surface 12 by a rotatably mounted fibrous brush 84 in contact therewith. A suitable brush cleaning device is described in U.S. Pat. No. 3,590,412 issued to Gerbasi in 1971.

It is believed that the foregoing description is sufficient for purposes of the present application to depict the general operation of the improved electrophotographic printing machine incorporating the features of the present invention therein.

Figure 2:
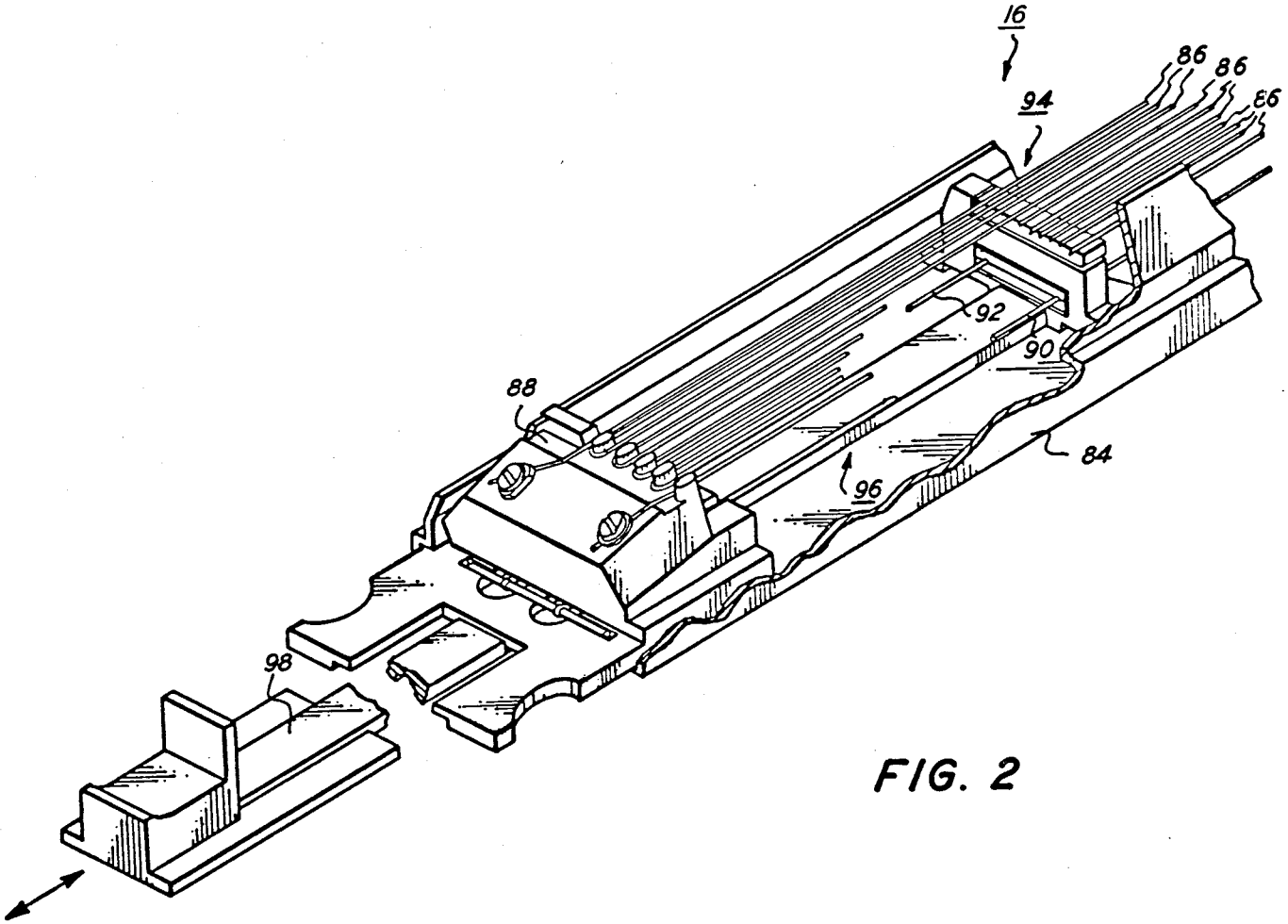
FIG. 2 is a perspective view of a corona generating device employed in the FIG. 1 printing machine.

Referring now to the specific sub-assemblies employed in the FIG. 1 printing machine, FIG. 2 depicts corona generating apparatus 16. Corona generating apparatus 16 includes an elongated conductive shield 84 defining an open-ended chamber opposed from and closely spaced to photoconductive surface 12. Shield 84 is a U-shaped housing and, preferably, is made from an aluminum extrusion. A plurality of substantially parallel spaced, find conductive wires 86 (in this case 10) extend in a longitudinal direction from one end of shield 84 to the other end thereof and across about three-quarters of the open end of the chamber therein. Insulating plate 88 is affixed permanently to both ends of shield 84 by suitable means (not shown) e.g. fasteners. Interposed between grid wires 86 and back wall 88 of shield 84 is a pair of coronode wires 90 and 92, respectively. Coronode wires 90 and 92 are suitably secured to insulating plate 88, preferably, by fasteners (not shown). Both grid wires 86 and coronode wires 90 and 92, respectively, are, preferably, made from a conductive material, as for example, platinum. Insulating plate 88 is preferably made from a dielectric material such as a glass alkyd, polycarbonate plastic, polymethylarcylate plastic, or the like. As illustrated in FIG. 2, coronode wire 90 is positioned in that portion of the chamber of shield 84 that is not covered by grid wires 86, i.e. grid wires 86 do not extend over this portion of the open end of shield 84. A high voltage source (not shown) excites coronode wires 90 and 92 to a voltage preferably ranging from about 6000 to about 8000 volts. A low voltage source (not shown) excites grid wires 86 to, preferably, about 800 volts.

In order to reduce the sensitivity of corona generating apparatus 16 to contamination, deposits of toner particles and dust collected on coronode wires 90 and 92 and grid wires 86 are removed therefrom by wiper member 94. Wiper member 94 is, preferably, formed of a slightly abrasive material such as felt, foam or expanded polyester. A support carriage, generally indicated at 96, reciprocates wiper member 94 along coronode wires 90 and 92 and grid wires 86. Support carriage 96 includes an elongated rod 98. Preferably, rod 98 extends longitudinally through the center of shield 84. In this manner, an operator may grasp rod 98 to reciprocate wiper member 94 to remove dust particles from coronode wires 90 and 92, as well as grid wires 86. Corona generating device 16 is described in greater detail in co-pending application Ser. No. 307,250 filed in 1972 now U.S. Pat. No. 3,942,006 issued to Hayne in 1976, the disclosure of which is hereby incorporated into the present application.

Figure 3:
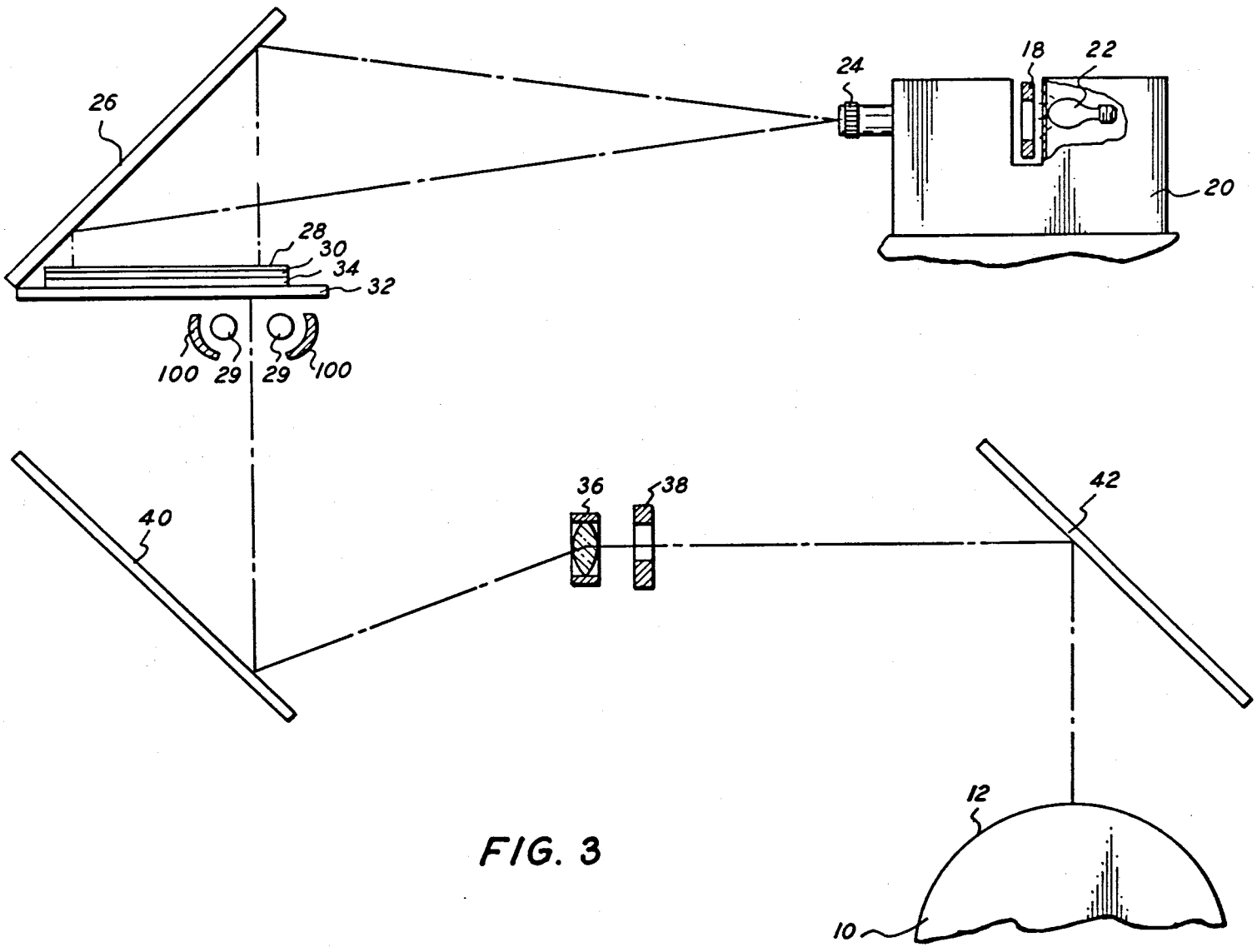
FIG. 3 is a schematic illustration of the optical system of the FIG. 1 printing machine.

Turning now to FIG. 3, exposure station B is described therein in greater detail. Lamps 29 and their respective reflectors 100 and 102 are arranged to traverse platen 32 illuminating incremental widths of composition frame 34 on platen 32. Lamps 29 are mounted on a suitable carriage which is driven by a cable pulley system from a drive motor rotating drum 10. As the lamp carriage traverses platen 32, another cable pulley system moves lens 36 and filter 38 at a correlated speed therewith. Filter assembly 38 is mounted by a suitable bracket on lens 36 to move in conjunction therewith. Lamps 29, lens 36 and filter 38 scan the combined image formed on platen 32 to produce a flowing light image thereof. The transparency image pases through modulating means or dot screen 30. Preferably, dot screen 30 includes a plurality of equally spaced soft gray square dots. In the preferred embodiment thereof, the dot screen comprises 85 dots per inch. However, this may range from about 65 to about 300 dots per inch. The foregoing is only limited by the optical system and the desired resolution. A suitable dot screen is manufactured by the Caprock Corporation and may be a negative screen. Slide projector 20 projects an enlarged image of color transparency 18 onto mirror 26. Preferably, projector 20 is a Kodak Carousel 750-H projector having an F/2.8 Ektanar C projection lens. However, any other suitable slide projector may also be employed, as for example the Kodak Carousel Custom 840-H projector. Projector 20 includes a light source 22 adapted to illuminate color transparency 18 and lens 24 arranged to produce an enlarged image of color transparency 18. Lens 24 has an adjustable focus to vary the magnification while maintaining the resultant image in focus. A size for size or "contact print" of a transparency may optionally be formed by placing transparency 18 on platen 32 below dot screen 30. In this mode, projector 20 is employed as an additional illumination source without a slide therein. The color transparency image transmitted to mirror 26 is reflected onto Fresnel lens 28. Preferably, Fresnel lens 28 has the general characteristic of being composed of small, recurring light deflecting elements that will, as an entire unit, perform to achieve a distribution of light over a predetermined area. The gratings or grooves of the lens are preferably about 200 or more per inch. Fresnel lens 28 converges the diverging light rays from lens 24 of projector 20. Thus, the light rays striking platen 32 on which the images formed are converging rays. Other suitable field lenses may be employed in lieu of a Fresnel lens. However, without such a lens, the light rays forming the image on platen 32 would continue through in a diverging manner. Hence, the combined image formed on platen 32 is scanned by lens 26 to form a flowing light image. The light rays are reflected from mirror 40 through lens 36 and filter 38 forming a single color light image which is reflected from mirror 42 onto charged photoconductive surface 12 of drum 10. It should be noted that Fresnel lens 28 and dot screen 30 may be interposed with one another without effecting the resultant image. Fresnel lens 28 is described in greater detail in U.S. Pat. No. 3,424,525 issued to Towers et al. in 1969, the relevant portions of that disclosure being hereby incorporated into the present application. Filter 38 is adapted to interpose selected color filters into the optical light path to create single color electrostatic latent images on photoconductive surface 12. Upon reaching the end of the path of scan, lamps 29, lens 36 and filter 38 are spring biased to return to their original positions for the start of the next successive cycle. It should be clear that the movement of lens 36, filter 38 and lamps 29 are correlated with the speed of rotation of drum 10 for exposure of charged photoconductive surface 12. For greater details regarding the drive system for the optical system, described in FIG. 3 and the operation thereof with the movement of drum 10, reference is made to U.S. Pat. No. 3,062,109 issued to Mayo et al. in 1962.

Preferably, lens 36 is a six-element split dagor type of lens having front and back compound lens components with a centrally located diaphragm therebetween. The lens system forms a high quality image with a field angle of 31° and a speed of F/4.5 at a 1:1 magnification. In addition, lens 36 is designed to minimize the effect of secondary color in the image plane. The front lens component has three lens elements including, in the following order, a first lens element of positive power, a second lens element of negative power cemented to the first lens element, and a third lens element of positive power disposed between the second lens element and a diaphragm. The back lens component also has three similar lens elements positioned so that lens 36 is symmetrical. In a specific embodiment of the lens, the first lens element in the front component is a double convex lens, the second element a double concave lens, and the third element a convex-concave lens element. For greater details regarding lens 36, reference is made to U.S. Pat. No. 3,592,531 issued to McCrobie in 1971, the disclosure of which is hereby incorporated into the present application.

With continued reference to FIG. 3, filter 38 includes a housing which is mounted on lens 36 by a suitable bracket and moves lens 36 during scanning as a single unit. The housing of filter 38 includes a window which is positioned relative to lens 36 permitting the light rays reflected from the combined image on platen 32 to pass therethrough. Bottom and top walls of the housing include a plurality of tracks which extend the entire width thereof. Each track is adapted to carry a filter in a manner to permit movement thereof from an inoperative position to an operative position. In the operative position, the filter is interposed in the window of the housing permitting the light rays to pass therethrough. Individual filters are made from any suitable filter material such as coated glass. Preferably, three filters are employed in the electrophotographic printing machine of FIG. 1. These filters are biased into position to be inserted into the window of the housing by individual extension springs. When not in operation, the filters are retained in the inoperative position. The filters are locked into position out of line of the housing window by means of stop pins, each pin extends up through an opening in the bottom of the housing into the respective track of each filter. A solenoid arm in association with the respective stop pin retains the filters in the inoperative position. A selected color filter is inserted into the optical path of the housing window by activation of the appropriate solenoid. Activating the selected solenoid removes the corresponding stop pin from the path of the filter, thereby allowing the appropriate spring to move the selected filter into the optical path of the housing window. The filter remains in the operative position in the housing window throughout the entire scanning process. During the return of the system to its initial position after completion of scan, the first filter is removed from the operative position and a second filter is inserted therein. Preferably, filter mechanism 38 includes a red filter, a blue filter and a green filter. Each of the filters is associated with its respective toner particles, i.e. the complement of the color thereof to produce a subtractive system. A green filtered light image is developed with magenta toner particles, a red filter light image with cyan toner particles, and a blue filtered light image with yellow toner particles. A detailed description of filter 38 is found in U.S. Pat. No. 3,775,006 issued to Hartman et al. in 1973, the disclosure thereof being hereby incorporated into the present application.

Figure 4:
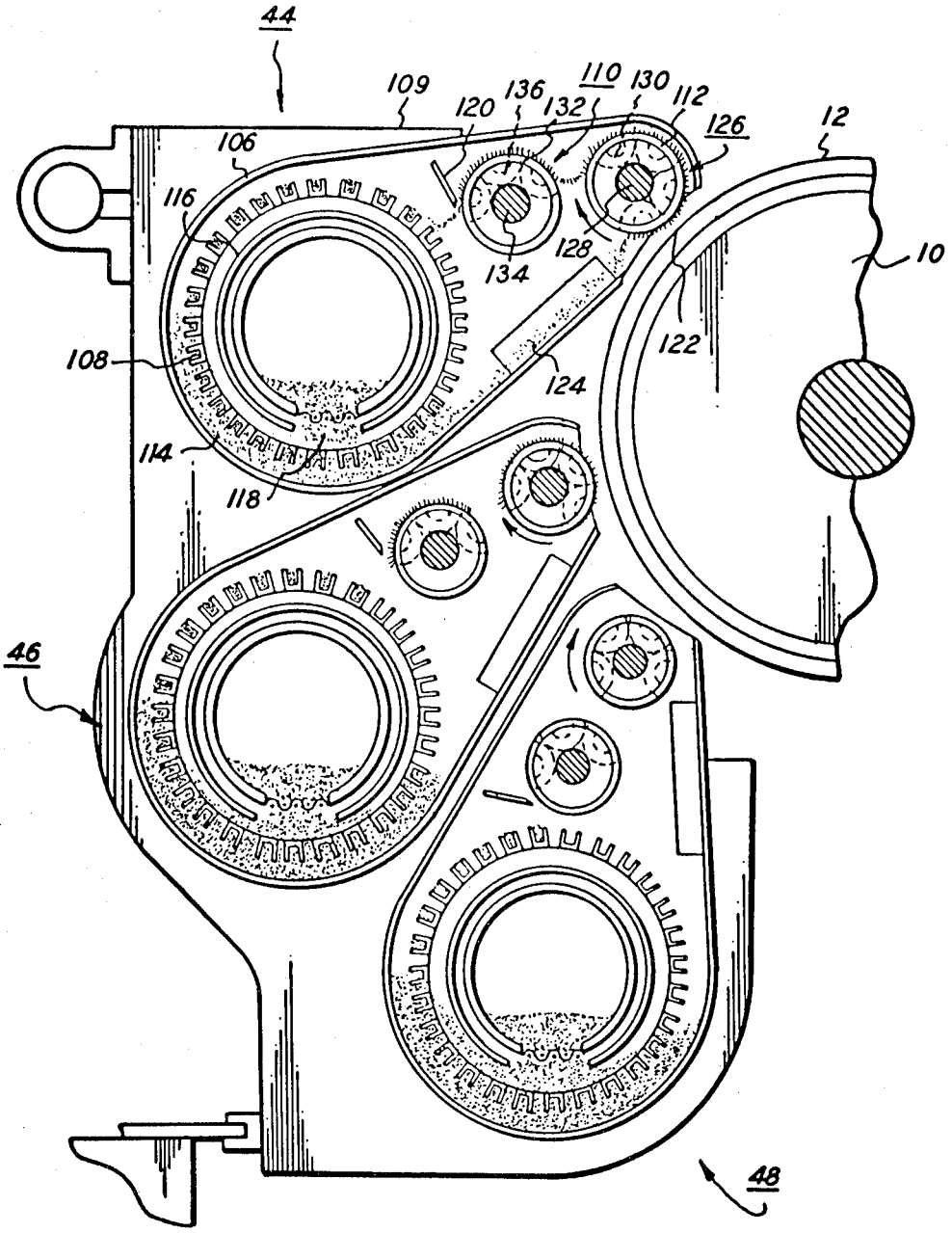
FIG. 4 is a sectional elevational view of the development system used in the FIG. 1 printing machine.

Referring now to FIG. 4, the development system of the FIG. 1 electrophotographic printing machine will be described in detail. As shown in FIG. 4, frame 104 supports three toner depositing means or development units 44, 46 and 48, respectively. These development units are depicted in an elevational sectional view to indicate more clearly the various components included therein. Only developer unit 44 will be described in detail as developer units 46 and 48 are nearly identical thereto. The distinctions between each of the developer units resides in the color of the toner particles contained therein and minor geometrical differences due to the mounting arrangement. Development unit 44 may have yellow toner particles, unit 46 magenta toner particles and unit 48 cyan toner particles. For purposes of explanation, developer unit 44 will hereinafter be described in greater detail.

The principal components of developer unit 44 are developer housing 106, conveyor means or paddle wheel 108, transport means or roll 110, and developer means or roll 112. Paddle wheel 108 is a cylindrical member with buckets or scoops around the periphery thereof and is adapted to rotate so as to elevate developer mix 114 from the lower region of housing 106 to the upper region thereof. When developer mix 114 reaches the upper region of housing 106, it is lifted from the paddle wheel by buckets to transport roll 110. Alternate buckets of paddle wheel 108 have apertures in the root diameter so that developer mix in these areas is not carried to transport roll 110 but, instead, falls back to the lower region of developer housing 106. As the developer mix falls back to the lower region of developer housing 106, it cascades over shroud 116 which is of a tubular configuration with aperture 118 in the lower region thereof. Developer mix 114 is recirculated in this manner so that the carrier granules are continually agitated to mix with fresh toner particles. This generates a strong triboelectric charge between the carrier granules and toner particles. As developer mix 114 in the paddle wheel buckets approaches transport roll 110, the magnetic fields produced by the fixed magnets therein attract developer mix 114 thereto. Transport roll 110 moves developer mix 114 in an upwardly direction by the frictional force exerted between the roll surface and developer mix. A surplus of developer mix 114 is furnished. Metering blade 120 is provided to control the amount of developer mix carried over the top of transport roll 110. The surplus developer mix is sheared from transport roll 110 and falls in a downwardly direction toward paddle wheel 108. As the surplus developer mix descends, it falls through the apertures of paddle wheel 108 in a downwardly direction into the lower region of developer housing 106. The developer mix which passes metering blade 120 is carried over transport roll 110 to developer roll 112 and into development zone 122 located between photoconductive surface 12 and developer roll 112. The electrostatic latent image recorded on photoconductive surface 12 is developed by contacting the moving developer mix. The charged areas of photoconductive surface 12 electrostatically attract the toner particles from the carrier granules of the developer mix. Upon passing from the development zone, the unused developer mix and denuded carrier granules enter a region relatively free from magnetic forces and fall from developer roll 112 in a downwardly direction to the lower region of developer housing 106. As the unused developer mix and denuded carrier granules descend they pass through mixing baffle 124 which directs the flow from the ends towards the center of developer housing 106 to provide mixing in this direction.

Developer roll 112 includes a non-magnetic tubular member 126, preferably made from an aluminum tube having an irregular or roughened exterior surface. Tubular member 126 is journaled for rotation by suitable means such as ball bearing mounts. A shaft 128 made, preferably, of steel is mounted in tubular member 126 and serves as a fixed mounting for magnetic means 130. Magnetic means 130, preferably, includes magnets made of barium ferrite in the form of annular rings which are arranged with five poles on about a 284° arc about shaft 128.

Similarly, transport roll 110 includes a non-magnetic tubular member 132, also, preferably made from an aluminum tube having an irregular or roughened exterior surface. Tubular member 132 is journaled for rotation by suitable means such as ball bearing mounts. A shaft 134, preferably made of steel, is concentrically mounted within tubular member 132 and functions as a fixed mounting for magnetic means 136. Magnetic means 134, preferably, includes barium ferrite magnets in the form of annular rings arranged with four poles on about a 180° arc about shaft 134.

The operation of developer unit 44 will hereinafter be briefly discussed. Developer housing 106 is pivoted about the center of paddle wheel 108 and is supported at the lower region of the exterior surface thereof by rollers mounted rotatably in frame 104. A spring pivots developer housing 106 against a stop. In this position, developer roll 112 is in the non-operative position spaced from photoconductive surface 12. Operation begins when a clutch gear meshes with a gear attached to paddle wheel 108. This causes paddle 108 to revolve clockwise. As paddle wheel 108 starts to rotate, a reaction torque is exerted against developer housing 106 due to the resistance to motion produced by developer mix 114 which fills developer housing 106. This reaction torque causes housing 106 to rotate clockwise against the force of the spring until a wheel is positioned against photoconductive surface 12 of drum 10. Rolls 110 and 112 are rotated in conjunction with paddle wheel 108 by a gear train. When the latent image recorded on photoconductive surface 12 of drum 10 has passed development zone 122, development action is discontinued and the developer mix removed from contact with photoconductive surface 12. To achieve this, the drive motor is de-energized from the gears by de-energizing the clutch leaving it free to rotate in either direction. Thus, paddle wheel 108, developer roll 112 and transport roll 110 stop rotating, and developer housing 106 is pivoted clockwise by the spring until it engages the stop in its inoperative position. This completes the cycle.

Each of the developer units is actuated by the timing disc (not shown) mounted on the shaft of drum 10. The timing disc is opaque with a plurality of spaced slots in the circumferential periphery thereof. The timing disc is interposed between an illuminating source and a photosensor to generate an electrical signal as each slot permits light rays to pass through the disc. This electrical signal, in association with suitable mach the logic, activates the appropriate developer unit. Thus, the yellow developer unit is activated when a blue filtered light image is projected onto photoconductive surface 12. Similarly, the magenta developer unit is activated when a green filtered light image is projected onto photoconductive surface 12 and the cyan developer unit is activated when a red filtered light image is projected onto photoconductive surface 12. Each of the aforementioned developer units operate substantially as developer unit 44. The development system discussed heretofore is disclosed in U.S. Pat. No. 3,854,449 issued to Davidson in 1974, the disclosure of which is incorporated into the present application.

Figure 5:
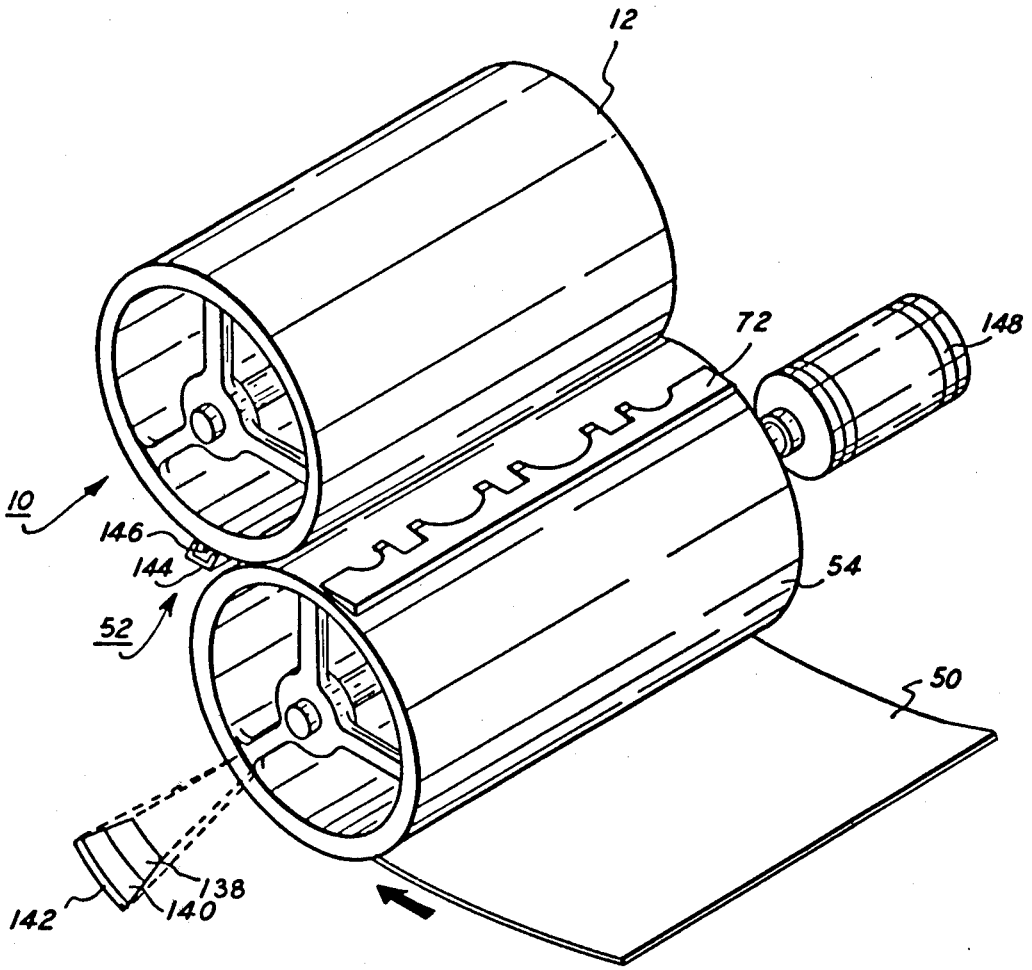
FIG. 5 is a schematic perspective view of the transfer system employed in the FIG. 1 printing machine.

Turning now to FIG. 5, the structural arrangement of transfer station D is disclosed herein in greater detail. Transfer roll 54 includes an aluminum tube 138, preferably having a one-quarter inch thick layer of urethane 140 cast thereabout. A polyurethane coating 142, preferably about 1 mil thick, is sprayed over the layer of cast urethane 140. Preferably transfer roll 54 has durometer hardness ranging from about 10 units to about 30 on the Shore A scale. The resistivity of transfer roll 54, preferably, ranges from about $10^8$ to about $10^{11}$ ohm centimeters. A direct current bias voltage is applied to aluminum tube 138 by suitable means, such as a carbon brush and brass ring assembly (not shown). The transfer voltage may range from about 1500 to about 4500 volts. Transfer roll 54 is substantially the same diameter as drum 10 and is driven at substantially the same angular velocity.

With continued reference to FIG. 5, corona generator 52 includes an elongated shield 144 made from a conductive material such as an aluminum extrusion. Elongated shield 144 is substantially U-shaped and may be grounded, or, in lieu thereof, biased to a suitable electrical voltage. A discharge electrode 146 is mounted in the chamber defined by a U-shaped shield 144. Discharge electrode 146 is, preferably, a platinum coronode wire approximately 0.0035 inches in diameter and extends longitudinally along the length of shield 144. Coronode 146 is excited so as to produce a flow of ions therefrom. The ions pre-condition the toner particles deposited on the electrostatic latent image of photoconductive surface 12. In this way, the efficiency of transfer roll 54 is enhanced to more readily attract the toner powder from the electrostatic latent image recorded on photoconductive surface 12 to support material 50. Preferably, discharge electrode 146 is excited at about 4400 volts rms, the range being from about 3000 volts rms to about 5000 volts rms. A motor is coupled directly to transfer roll 54 by a flexible metal bellows 148 which permits lowering and raising of transfer roll 54. Synchronization of transfer roll 54 and drum 10 is accomplished by gears and a flexible coupling connecting the main drive motor to both transfer roll 54 and drum 10. This permits transfer roll 54 to be moved into and out of engagement with photoconductive surface 12. The foregoing arrangement for transferring toner powder image to the sheet of support material is described in greater detail in U.S. Pat. No. 3,838,918 issued to Fisher in 1974, the disclosure of which is hereby incorporated into the present application.

Figure 6:
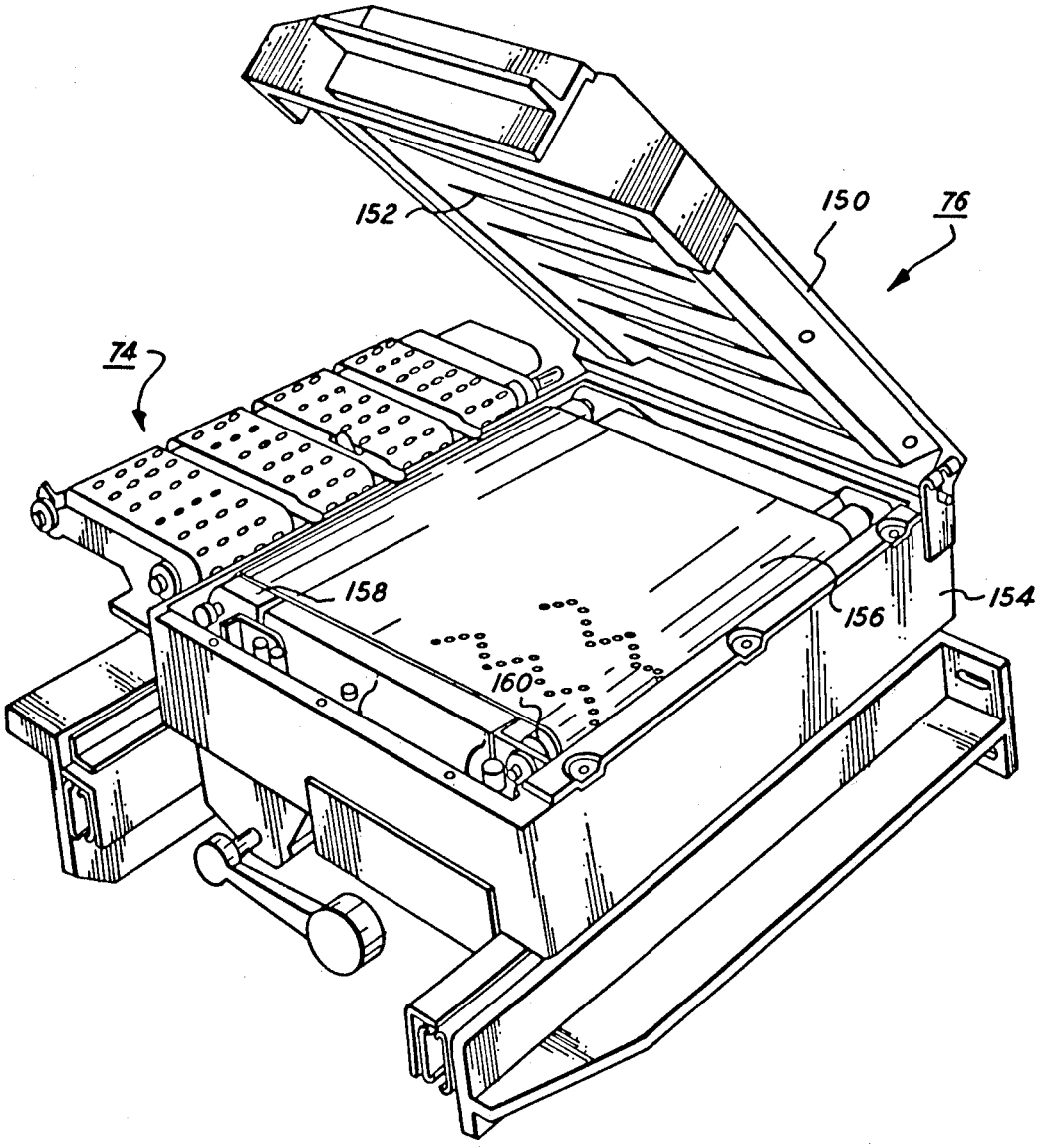
FIG. 6 is a perspective view of the FIG. 1 printing machine fuser.

Referring now to FIG. 6, fuser 76 will be described hereinafter in greater detail. Conveyor 74 which includes a plurality of apertures therein and a vacuum system for tacking the sheet of support material thereto advances the sheet of support material to fuser 76. Fuser 76 includes a cover 150 formed from a sheet metal shell having secured to the interior surface thereon suitable insulation. A nylon fiber coating is sprayed on the exterior surface of cover 150 to protect the operator. An outer reflector is suitably attached to the insulation secured to the interior surface of the metal shell of the cover. An inner reflector is mounted on the outer reflector. As mounted, the inner and outer reflectors are spaced from one another permitting air to circulate therebetween. A thermistor is positioned in the air space between the inner and outer reflectors to measure the temperature thereat. Radiant energy source 152 is preferably a heat strip made from a nickel chromium alloy ribbon entrained helically about a pair of opposed spaced support members, such as ceramic spools. Heat strip 152 is arranged to provide substantially uniform radiation. A suitable guide, preferably a quartz woven string, is wound over heat strips 152 and adapted to prevent support material 50 from contacting it.

Lower housing 154 includes a sheet metal shell having insulation secured to the interior surface thereof. An endless belt 156 is entrained about a pair of rollers 158 and 160 secured rotatably in lower housing 154. The interior surface of belt 156 is adapted to be closely adjacent to a heated plate. The plate is heated by air. A blower member mounted in housing 154 passes heated air from an auxiliary heater onto the plate raising the temperature thereof. The plate is closely adjacent to the under surface of endless belt 156. This, in turn, raises the temperature of the support material minimizing any heat loss therefrom. In this manner, radiant energy from heat strips 152, in conjunction with the auxiliary heater fuse the toner powder image formed on support material 50. Fuser 76 is described in greater detail in U.S. Patent No. 3,781,516 issued to Tsilibes et al. in 1973, the disclosure of which is hereby incorporated into the present application.

In recapitulation, the electrophotographic printing machine depicted in FIG. 1 is adapted to produce color copies from a color transparency. The transparency may be copied size for size or enlarged and may have the composition frame with or without indicia thereon combined therewith. The color transparency may be a conventional 35mm slide. The foregoing is achieved by projecting an image of the color transparency through a Fresnel lens and dot screen onto the platen. In this way, a modulated image of the color transparency is created on the platen of the electrophotographic printing machine. Thereupon, the combined image is scanned by the exposure system and a flowing light image is produced. A suitable filter is interposed into the optical light path forming a single color light image which irradiates the charged photoconductive surface. This single color electrostatic latent image is then developed with toner particles complementary in color to the filtered light image. Successive single color electrostatic latent images are developed with their correspondingly complementarily colored toner particles. The toner particles are transferred, in superimposed registration with one another, to a sheet of support material forming a multi-layered toner powder image thereon. The multilayered toner powder image is permanently affixed to the sheet of support material by a fusing apparatus. The resultant color copy is removed from the printing machine and corresponds to a combined picture of the composition frame and color transparency.

Thus, it is apparent that there has been provided, in accordance with the present invention, an electrophotographic printing machine that fully satisfies the objects, aims and advantages set forth above. While this invention has been disclosed in conjunction with a specific embodiment thereof, it is evident that many alternatives, modifications and variations will be apparent to those skilled in the art in light of the foregoing description. Accordingly, it is intended to embrace all such alternatives, modifications and variations that fall within the spirit and broad scope of the appended claims.

What is claimed is:

1. An electrophotographic printing machine for reproducing a color transparency, including:

a platen;

means for projecting a light image of the color transparency onto said platen;

a screen member disposed on said platen for modulating the light image of the color transparency projected onto said platen to form a half-tone light image thereof;

a composition frame disposed on said platen defining an opaque border extending outwardly from the color transparency image formed on said platen;

a photoconductive member;

means for charging at least a portion of said photoconductive member, said charging means comprising an elongated shield defining an open ended chamber, a pair of spaced, substantially parallel conductive coronode wires mounted in said shield, said pair of coronode wires extending substantially in a longitudinal direction along the length of said shield, and a plurality of spaced, substantially parallel grid wires mounted in said shield and extending substantially in a longitudinal direction along the length thereof, said plurality of grid wires partially enclosing the open end of said shield with one of said coronode wires being disposed in the chamber therebeneath and the other of said coronode wires being disposed in the unenclosed portion of the chamber of said shield;

means for filtering the half-tone light image means for exposing the charged portion of said photoconductive member to a light image of said composition frame and the filtered half-tone light image of the color transparency to record on said photoconductive member a combined electrostatic latent image of the color transparency and said composition frame;

means for developing the electrostatic latent image recorded on said photoconductive member with toner particles complementary in color to the color of the filtered half-tone light image;

means for transferring the toner powder image adhering to the combined electrostatic latent image recorded on said photoconductive member to a sheet of support material; and means for fusing the toner powder image to the sheet of support material.

2. A printing machine as recited in claim 1, wherein said charging means further includes:

a wiper member positioned within said shield contacting said pair of coronode wires and the interior surface of said grid wires opposed from said pair of coronode wires; and means for moving said wiper member in substantially a longitudinal direction along the length of said coronode wires and said grid wires.

* * * * *